US008523470B2

(12) United States Patent
Palo et al.

(10) Patent No.: US 8,523,470 B2
(45) Date of Patent: Sep. 3, 2013

(54) COMBINED LIPSTICK, LIP GLOSS AND LIP LINER BULLET

(75) Inventors: Arlette Palo, New York, NY (US); John R. Castro, Hauppauge, NY (US); Charles P. Neuner, Amityville, NY (US)

(73) Assignee: ELC Management, LLC, New York, NY (US)

( * ) Notice: Subject to any disclaimer, the term of this patent is extended or adjusted under 35 U.S.C. 154(b) by 20 days.

(21) Appl. No.: 13/462,578

(22) Filed: May 2, 2012

(65) Prior Publication Data

US 2013/0118516 A1 May 16, 2013

Related U.S. Application Data

(60) Provisional application No. 61/489,342, filed on May 24, 2011.

(51) Int. Cl.
*B43K 27/08* (2006.01)

(52) U.S. Cl.
USPC ..... 401/35; 401/34

(58) Field of Classification Search
USPC ..... 401/19, 34, 35, 49, 52, 68, 75
See application file for complete search history.

(56) References Cited

U.S. PATENT DOCUMENTS

| | | | |
|---|---|---|---|
| 1,304,590 | A | 5/1919 | Nardi |
| 1,576,567 | A | 3/1926 | Buhl-Bonanno |
| 1,623,509 | A | 4/1927 | Vivaudou |
| 1,933,538 | A | 11/1933 | Brazellon |
| 1,966,884 | A | 7/1934 | Coe |
| 2,142,312 | A | 1/1939 | Heinz |
| 2,344,883 | A | 3/1944 | Kairalla |
| 2,419,526 | A | 4/1947 | Anderson |
| 2,491,723 | A | 12/1949 | Gelardin |
| 2,491,724 | A | 12/1949 | Gelardin |
| 2,523,683 | A | 9/1950 | DeMario |
| 2,766,876 | A | 10/1956 | Hopgood |
| 3,001,531 | A | 9/1961 | Gazdik |

(Continued)

FOREIGN PATENT DOCUMENTS

| | | |
|---|---|---|
| WO | WO98/46436 | 10/1998 |

OTHER PUBLICATIONS

PCT International Search Report; International Applicaton No. PCT/US2012/036161; Completion Date: Nov. 29, 2012; Mailing Date: Nov. 30, 2012.

(Continued)

*Primary Examiner* — David Walczak
(74) *Attorney, Agent, or Firm* — Martin W. Haerter

(57) ABSTRACT

A lipstick, lip gloss and lip liner are arranged in a single bullet-shaped body. The lip gloss forms a core of the body and the lipstick forms a sheath that coaxially envelopes the lip gloss core. The body has an upper lip liner part that extends along a first side, and a lower lip liner part that extends along the a second side of the body opposite the first side. The cross-section of the body is a pendant shape. An upper half of the pendant shape is wedge-shaped and defines an apex. A lower half of the pendant shape is semi-circular shaped and defines a rounded portion. The upper lip liner part is positioned in the apex and the lower lip liner part is positioned in a center of the rounded portion.

10 Claims, 3 Drawing Sheets

(56) References Cited

U.S. PATENT DOCUMENTS

| | | | | |
|---|---|---|---|---|
| 3,044,612 | A | | 7/1962 | Levine |
| 3,091,329 | A | | 5/1963 | Levine |
| 3,192,933 | A | * | 7/1965 | Prince ..... 401/35 |
| 3,320,962 | A | | 5/1967 | Moriber et al. |
| 4,291,018 | A | | 9/1981 | Oeda et al. |
| 4,602,886 | A | * | 7/1986 | Smit ..... 401/35 |
| 4,740,097 | A | | 4/1988 | Kapustin |
| 4,743,443 | A | | 5/1988 | Pisani et al. |
| D298,198 | S | | 10/1988 | O'Sullivan |
| 4,778,300 | A | | 10/1988 | French et al. |
| 5,109,877 | A | | 5/1992 | Takeda |
| D331,815 | S | | 12/1992 | DiSomma et al. |
| D342,586 | S | | 12/1993 | Lobo |
| 5,980,924 | A | | 11/1999 | Yamazaki et al. |
| D446,356 | S | | 8/2001 | Look |
| D454,985 | S | | 3/2002 | Look |
| D456,099 | S | | 4/2002 | Look |
| D456,953 | S | | 5/2002 | Look |
| 6,695,510 | B1 | | 2/2004 | Look et al. |
| 6,895,628 | B1 | | 5/2005 | Anderson |
| 7,073,965 | B2 | | 7/2006 | Look et al. |
| D626,286 | S | | 10/2010 | Karches |
| 2002/0127192 | A1 | | 9/2002 | Murphy et al. |
| 2002/0182157 | A1 | | 12/2002 | Grayson |
| 2007/0231355 | A1 | | 10/2007 | Quadir et al. |
| 2008/0298876 | A1 | | 12/2008 | Porter et al. |

OTHER PUBLICATIONS

PCT Written Opinion of the International Searching Authority; International Application No. PCT/US2012/036161; Completion Date: Nov. 28, 2012; Mailing Date: Nov. 30, 2012.

* cited by examiner

COMBINED LIPSTICK, LIP GLOSS AND LIP LINER BULLET

CROSS-REFERENCE TO RELATED APPLICATIONS

This application claims priority from U.S. provisional application 61/489,342 filed May 24, 2011.

BACKGROUND OF THE INVENTION

1. Field of the Invention

This invention relates to lip cosmetics. More particularly, the invention relates to a combined lipstick, lip gloss and lip liner arranged in a single bullet, and methods of using the bullet.

2. Description of the Prior Art

Lip cosmetic products are available in several different general forms. Lipstick, for example, is used generally to cover the lips, and is commonly provided in the form of a waxy, bullet shaped body that is applied directly to and rubbed directly on the lips to transfer a coating of the lipstick compound. Lip liner is used to highlight and define the edges of the lips and may be provided in a liquid form for application with a brush or doe foot applicator, or may be provided in a substantially solid stick form in a pencil. Lip gloss is generally provided in a pasty form that is applied with a brush or other suitable applicator. While lip gloss is often applied generally to the entire lip surface, it is particularly well suited for emphasizing the fullness of the plumper portions of the lips. The various forms of lip products will often be used in combination by sequentially applying each product to a particular zone of the lips to achieve a desired finished look.

Combined lip products are known. For example, U.S. Pat. No. 1,576,567 to Buhl-Bonanno discloses a combination lipstick in which one half of the lipstick consists of cold cream and the other half consists of rouge. U.S. Pat. No. 3,192,933 to Prince discloses two shades concentrically arranged in a lipstick bullet. U.S. Pat. No. 4,291,018 to Oeda et al. discloses a lipstick of the core-sheath type comprising two compositions, one consisting of low viscosity oil and wax, and the other consisting of a viscous oily ingredient and a waxy ingredient, and wherein the difference in hardness or melting point between the core and the sheath is not unduly great. U.S. Pat. No. 4,740,097 to Kapustin discloses a combined lip liner and lipstick mass. U.S. Pat. No. 4,743,443 to Pisani et al. discloses a side-by-side type laminar tri-color or alternating bi-color lipstick. WO 90/46436 to Stepniewski et al. discloses in a lipstick bullet two contrasting colors with one color semi-concentrically arranged about the other color. U.S. Pat. No. 6,695,510 to Look et al. discloses a multi-composition stick product wherein the stick includes at least two compositions in a non-random, reproducible pattern and the compositions differ in at least one component, such as a medicament, colorant, fragrance, flavorant, sunscreen, preservative, conditioner, moisturizer, emollient or surfactant.

The prior art does not disclose or suggest a combination lipstick, lip gloss and lip liner in a single bullet.

BRIEF SUMMARY OF THE INVENTION

The present invention is a combined lipstick, lip gloss and lip liner arranged in a single bullet-shaped body (also referred to as a "bullet"). The body has a longitudinal axis and a cross-section. The cross-section defines a periphery of the body. The body includes a lip gloss core, a lipstick sheath and at least two lip liner parts. The lip gloss core is centered in the body along the longitudinal axis. The lipstick forms a sheath that coaxially envelopes the lip gloss core. A first lip liner part extends along the longitudinal axis on the periphery on a first side of body. A second lip liner part extends along the longitudinal axis on the periphery on a second side of the body opposite the first side. The cross-section of the body is preferably a pendant shape having a wedge-shaped upper half defining an apex in the periphery and a semi-circular shaped lower half defining a rounded portion of the periphery. The first lip liner part is positioned on the periphery in the apex and the second lip liner part is positioned on the periphery at approximately a center of the rounded portion.

DETAILED DESCRIPTION OF THE INVENTION

Figure 1:
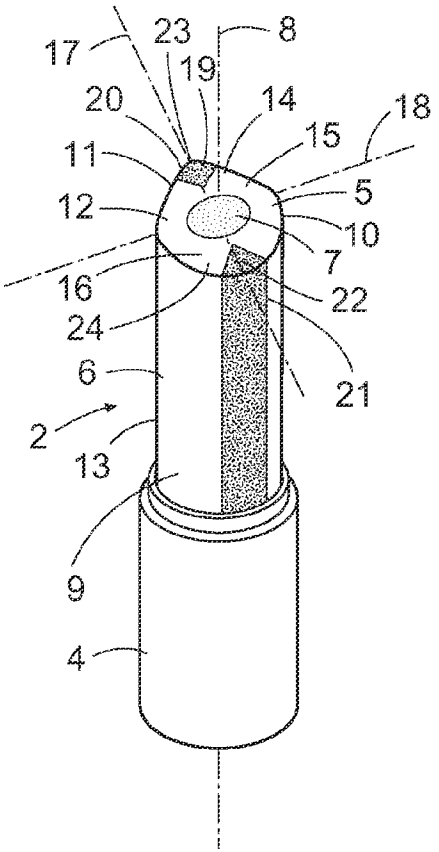
FIG. 1 is a top, front and left side perspective view of the combined lipstick, lip gloss and lip liner bullet of the present invention.
Figure 2:
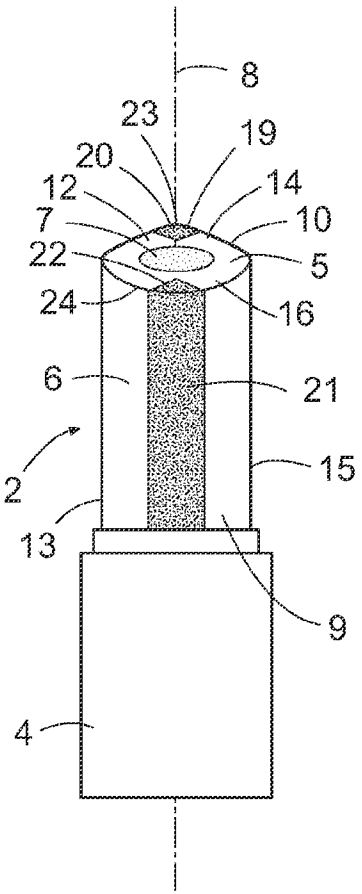
FIG. 2 is a front elevation view of the bullet shown in FIG. 1.
Figure 3:
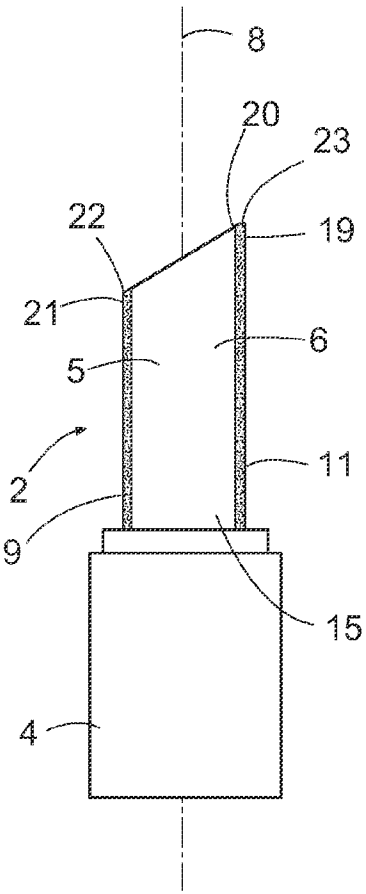
FIG. 3 is a right side elevation view of the bullet show in FIG. 1.
Figure 4:
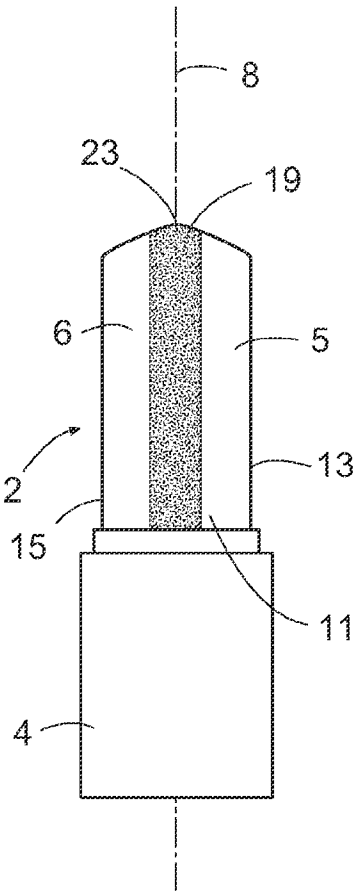
FIG. 4 is a rear elevation view of the bullet show in FIG. 1.

Referring now to FIGS. 1-4, a combined lipstick, lip gloss and lip liner bullet 2 is shown. For illustrative purposes, the bullet 2 is shown secured in a base 4 that supports the bullet 2 and serves as a handle for the user to conveniently hold the bullet 2. It will be understood that the bullet 2 may be secured in any suitable base or lipstick case, such as, for example, the cases disclosed in U.S. Pat. Nos. 1,966,884, 2,344,883, 2,419,526, 1,576,567, 6,695,510, each incorporated herein in its entirety by reference. The bullet 2 has a body 6 defining a longitudinal axis 8. A shape of the body 6 also defines a cross-section of the bullet 2. The cross-section in turn defines a periphery 10 of the body 6. The bullet 2 has a front side 9, a back side 11, a left side 13 and a right side 15. In FIG. 1, a first radial axis 17 is illustrated from the front side 9 through the middle of the cross-section of the bullet 2 to the back side 11 at approximately the widest point front-to-back. A second radial axis 18 is illustrated from the left side 13 through the middle of the cross-section of the bullet 2 to the right side 15 at the widest dimension of the bullet from side-to-side.

The body 6 further comprises an application face 12 that is approximately defined by the cross-section of the bullet 2. The application face 12 may be perpendicular to the longitudinal axis 8, or the face 12 may be angled relative to a perpendicular line or plane taken through the longitudinal axis 8. The application face 12 has an upper portion 14 extending from approximately the center of the bullet 2 to the back side 11 of the bullet 2, and a lower portion 16 extending from the upper portion 14 to the front side 9 of the bullet 2.

The bullet 2 has a lip gloss core 7 centered in the body 6 along the longitudinal axis 8. The bullet 2 further has a lipstick sheath 5 coaxially enveloping the lip gloss core 7. An upper lip liner part 19 is positioned in the sheath 5 such that an upper lip liner end 20 is exposed in the upper portion 14 of the application face 12 on the periphery 10. The upper lip liner part 19 extends parallel to the longitudinal axis 8 on a first side of the body, which is the back side 11 in the embodiments illustrated. A lower lip liner part 21 is positioned in the sheath such that an end 22 (lower lip liner end) is exposed in the lower portion 16 of the application face 12 on the periphery 10. The lower lip liner part 21 extends parallel to the longitudinal axis 8 on a second side of the body opposite the first side. The second side of the body is the front side 9 in the embodiments illustrated.

In a preferred embodiment, the cross-section of the combined lipstick, lip gloss and lip liner bullet is a pendant shape as illustrated in FIGS. 1-4 and 7-13. The pendant shape has a wedge-shaped upper half corresponding substantially to the upper portion 14 of the application face 12. The wedge-shaped upper half of the pendant shape defines an apex 23 in the periphery 10. The pendant shape has a semi-circular shaped lower half corresponding substantially to the lower portion 16 of the application face 12 defining a rounded portion 24 of the periphery. Preferably, the upper lip liner part 19 is positioned on the periphery 10 in the apex 23 and the lower lip liner part 21 is positioned on the periphery 10 at approximately a center of the rounded portion 24. In the preferred embodiment, the upper lip liner part 19, the lower lip liner part 21 and the core 7 are aligned along a line taken through a center point of the body, the center of the rounded portion 24 and the apex 23, such as, for example, radial axis 17 of the body 6.

Figure 5:
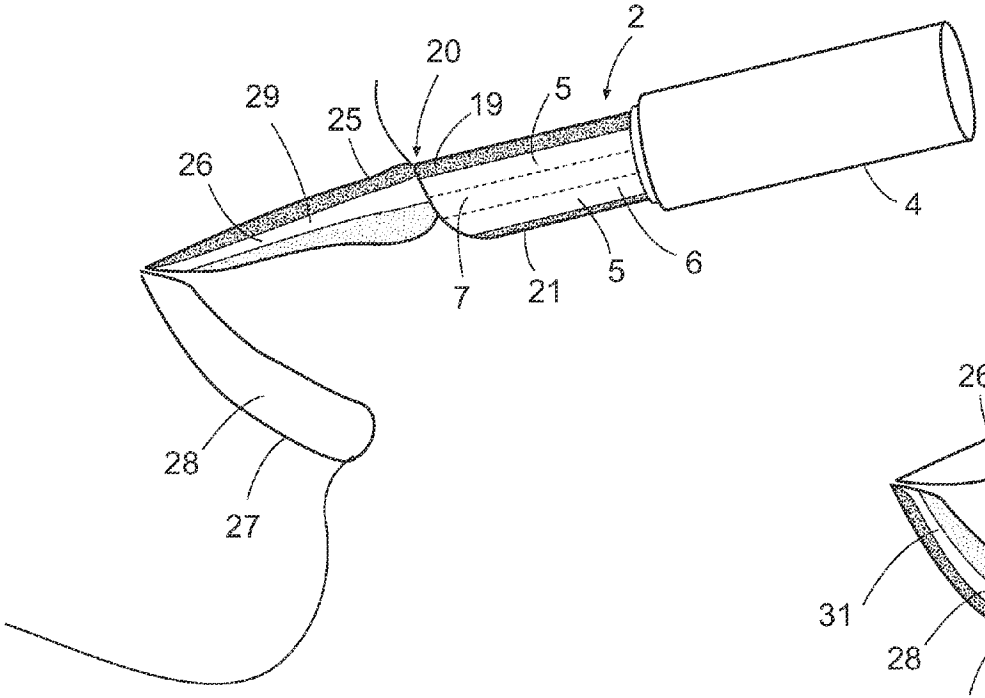
FIG. 5 is an illustration of the bullet of FIG. 1 as used to apply lipstick, lip gloss and lip liner simultaneously to an upper lip.
Figure 7:
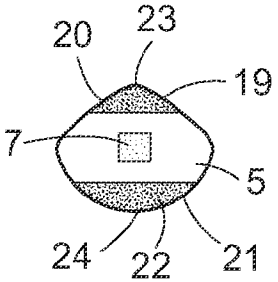
FIGS. 7-13 illustrate various embodiments of the cross-section of the lipstick, lip gloss and lip liner bullet of the invention.
Figure 9:
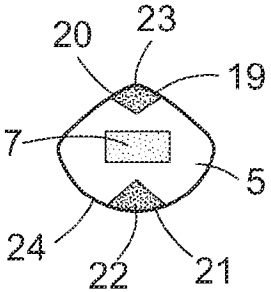
Figure 11:
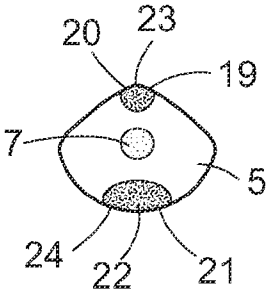
Figure 13:
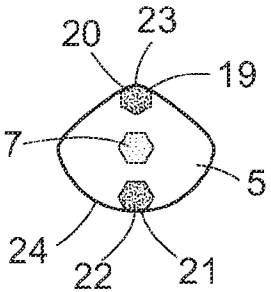
Figure 8:
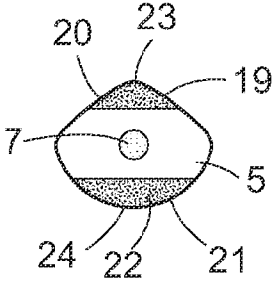
Figure 10:
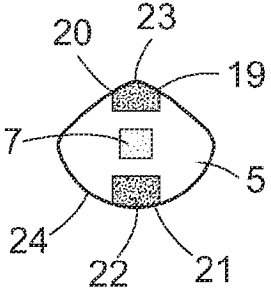
Figure 12:
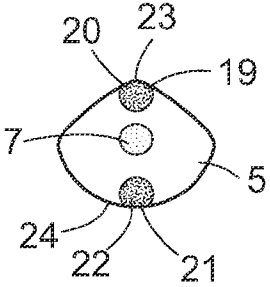

The upper lip liner part 19 is dimensioned and adapted to be applied to an upper edge 25 of an upper lip 26 as illustrated in FIG. 5. The exposed upper lip liner end 20 of the upper lip liner part 19 in the application face 12 contacts and deposits lip liner onto the upper edge 25 of the upper lip 26. FIG. 5 further illustrates how, as lip liner is applied from the upper lip liner part 19 to the upper edge 25 of upper lip 26, simultaneously, lipstick from the sheath 5 is applied to a middle portion 29 of the upper lip 26, and lip gloss is applied from the core 7 to a lower portion 30 of the upper lip 26.

Figure 6:
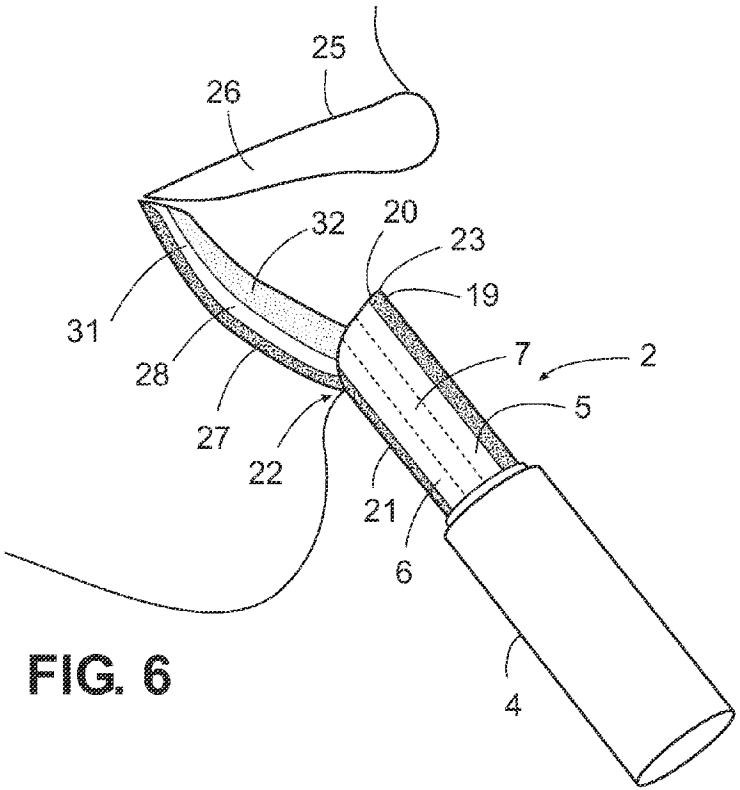
FIG. 6 is an illustration of the bullet of FIG. 1 as used to apply lipstick, lip gloss and lip liner simultaneously to a lower lip.

Similarly, the lower lip liner part 21 is dimensioned and adapted to be applied to a lower edge 27 of a lower lip 28 as illustrated in FIG. 6. The exposed lower lip liner end 22 of the lower lip liner part 21 in the application face 12 contacts and deposits lip liner onto the lower edge 27 of the lower lip 28. FIG. 6 further illustrates how, as lip liner is applied from the lower lip liner part 21 to the lower edge 27 of the lower lip 28, simultaneously, lipstick from the sheath 5 is applied to a middle portion 31 of lower lip 28, and lip gloss is applied from the core 7 to an upper portion 32 of the lower lip 28.

A cross-section of the upper lip liner part 19 may take any shape suitable for applying lip liner to the upper lip of a user. Similarly, a cross-section of the lower lip liner part 21 may take any shape suitable for applying lip liner to the lower lip of a user. Accordingly, a cross-section of at least one of the upper lip liner part 19 or the lower lip liner part 21 may be selected, for example, from one of a circle, an oval, a semi-circle, a triangle, a square, a rectangle, a hexagon, a trapezoid or a combination thereof. See FIGS. 7-13 for representative examples.

A cross-section of the core 7 may take any shape suitable for applying lip gloss to the middle portions 29, 32 of the upper and lower lips, respectively. Accordingly, the cross-section of the core 7 is selected from one of a circle, an oval, a semi-circle, a triangle, a square, a rectangle, a hexagon, a trapezoid or a combination thereof. See FIGS. 7-13 for representative examples.

While the preferred cross-section of the body 6 is the pendant shape discussed above, the cross-section of the body 6 may take any shape suitable for applying lip gloss, lipstick and lip liner. For example, the cross section of the body 6 may be selected from one of a pendant, a circle, an oval, a semi-circle, a triangle, a square, a rectangle, a hexagon, a trapezoid or a combination thereof.

The preferred embodiment of the combined lipstick, lip gloss and lip liner bullet 2 comprises a body 6 defining a longitudinal axis 8 and a cross-section of the bullet 2. The cross-section defines a periphery 10 of the body 6. The cross section is a pendant shape having a wedge-shaped upper half (corresponding substantially to the upper portion 14 of the application face 12) defining an apex 23 in the periphery 10 and a semi-circular shaped lower half (corresponding substantially to the lower portion 16 of the application face 12) defining a rounded portion 24 of the periphery 10. The body further comprises an application face 12 approximately defined by the cross-section of the bullet 2. The application face 12 has an upper portion 14 and a lower portion 16. A lip gloss core 7 is centered in the body 6 along the longitudinal axis 8. A lipstick sheath 5 coaxially envelops the lip gloss core 7. An upper lip liner part 19 is positioned in the sheath 5 such that an end 20 of the upper lip liner part 19 is exposed in the upper portion 14 of the application face 12 on the periphery 10. The upper lip liner part 19 extends parallel to the longitudinal axis 8 on a first side of the body corresponding to the back side 11. The upper lip liner part 19 is dimensioned and adapted to be applied to an upper edge 25 of an upper lip 26.

A lower lip liner part 21 is positioned in the sheath 5 such that an end 22 of the lower lip liner part 21 is exposed in the lower portion 16 of the application face 12 on the periphery 10. The lower lip liner part 21 extends parallel to the longitudinal axis 8 on a second side of the body 6 opposite the first side. The second side of the body 6 corresponds to the front side 9 in the embodiments illustrated. The lower lip liner part 21 is dimensioned and adapted to be applied to a lower edge 27 of a lower lip 28.

The combined lipstick, lip gloss and lip liner bullet is used by placing the upper portion 14 of the application face 12 against an upper lip 26 such that the exposed end 20 of the upper lip liner part 19 contacts an upper edge 25 of the upper lip 26. At least a portion of the lipstick sheath 5 and lip gloss core 7 contact the upper lip 26. The bullet 2 is drawn laterally across the lip 26 to simultaneously deposit lipstick, lip gloss and lip liner on the upper lip. Then the lower portion 16 of the application face 12 is placed against a lower lip 28 such that the exposed end 22 of the lower lip liner part 21 contacts a lower edge 27 of the lower lip 28. At least a portion of the lipstick sheath 5 and lip gloss core 7 contact the lower lip 28. The bullet 2 is then drawn laterally across the lower lip 28 to simultaneously deposit lipstick, lip gloss and lip liner.

The bullet 2 of the present invention can be manufactured by any well known means, such as, for example, insert molding. Suitable means for manufacturing the invention are disclosed and described in detail in, for example, U.S. Pat. Nos. 6,695,510, 4,740,097, 4,743,443 and 4,291,018, each incorporated by reference herein in its entirety.

The composition of the sheath 5 can be any suitable lipstick composition. Non-limiting examples of typical lipstick compositions are disclosed in U.S. Pat. No. 4,996,044 to Mercado et al., incorporated by reference herein in its entirety. For example, Mercado et al. in example 7 disclose the following formula:

| Ingredient | Parts by Weight |
|---|---|
| *Base intermediate | 65 |
| Softener | 7.4 |
| Castor oil | 2.0 |
| Lanolin oil | 5.4 |
| Color intermediate | 24.6 |
| Orange 5,3655 | 0.07 |
| Red 21,14032 | 0.07 |
| Red 6, C19-028 | 6.3 |
| Pink 3571 | 0.4 |
| Red 7,7044 | 0.9 |
| Yellow 6,5270 | 0.4 |
| Castor oil | 16.5 |
| Propyl paraben | 0.005 |
| Butylated hydroxyanisole | 0.025 |
| Acrylates copolymer intermediate | |
| Acrylates copolymer | 1.8 |
| Castor oil | 0.9 |
| Fragrance | 0.3 |

| *Base intermediate | % by Weight of Base intermediate |
|---|---|
| Candelilla wax | 20 |
| Cetyl alcohol | 6.7 |
| Ozokerite | 3.8 |
| Lanolin alcohol | 15.3 |
| Beeswax | 1.4 |
| Hydrogenated vegetable oil | 8 |
| Petrolatum white | 4 |
| Lanolin oil | 10.7 |
| Mineral oil | 9.2 |
| Oleyl alcohol | 19.4 |
| Propyl paraben | 0.2 |
| Wheat germ glycerides | 1 |
| Hydrolyzed animal protein | 0.5 |
| Vitamin E, dl-alpha tocopherol | 0.05 |

The composition of the lip gloss core 7 may be any suitable lip gloss composition. For example, the following general formula may be used for the lip gloss core:

| Lip gloss: | |
|---|---|
| 75% | Polybutene |
| 5% | Triisostearyl citrate |
| 10% | Polyethylene |
| 0.10% | Propyl paraben |
| QS | Pigments and pearls |

Additionally, the gloss core may be provided with different effects, such as, for example, ingredients to provide a pearl, glitter or other effect to the gloss.

The composition of the upper and lower lip liner parts 19, 21, respectively, may be any suitable lip liner composition. For example, the following general formula may be used for the lip liner parts:

| Lip Liner stick: | |
|---|---|
| 50% | Mineral oil |
| 10% | Kaolin |
| 10% | Hydrogenated cocogycerides |
| 15% | Pigments and pearls |

-continued

| Lip Liner stick: | |
|---|---|
| 5% | Carnauba wax |
| 10% | Polyethylene wax |

Additionally, a non-pigmented liner (a "reverse lip liner") may be used instead of a shaded lip liner. The reverse lip liner is believed to keep a bold colored lipstick portion from feathering and bleeding.

For lip care benefits, the composition of the bullet 2 can include a treatment active or composition, either in the core, sheath or lip liners.

The invention provides the benefits and properties of a lip liner, a lip gloss and a color lipstick in one molded bullet. By laying down in a single pass three different compositions, i.e., a lipstick, a lip gloss and a lip liner, respectively embodying three different shades and/or product textures, the product provides three in one product lay-down in a manner that is convenient and expeditious. Each different composition is placed in the bullet such that it is located, respectively, precisely where it is needed. The lipstick sheath lays down a colored lipstick generally on the middle portion of the lip. The lip gloss core centered in the bullet lays down lip gloss on the meaty, plump portions of the lips to enhance and emphasize the fullness of the lips. The upper lip liner is positioned in the bullet to lay down lip liner on the upper edge of the upper lip, but is not intended to touch the lower lip when the lower lip is coated. The lower lip liner is positioned in the bullet to lay down lip liner on the lower edge of the lower lip, but is not intended to touch the upper lip when the upper lip is coated.

By providing three different compositions in a specific arrangement, i.e., a lip gloss core, a lipstick sheath and upper and lower lip liner portions, the present invention has the distinction of a three-in-one design for a functional benefit. Prior art references appear to have the same formula in differing decorative configurations, or have at most two different formulas. In addition to having three different compositions, in the present invention, the upper and lower lip liner portions are strategically positioned, respectively, on the back side and front side of the bullet as held by the user for precise lining of the upper edge of the upper lip when the upper lip is coated and, similarly, precise lining of the lower edge of the lower lip when the lower lip is coated. The novel features of the present invention include the combination of the three different compositions, and the location of the three compositions in the cross-section of the bullet. The arrangement has a specific functional benefit in product lay down, delivering lip liner to the appropriate edges of the lips and delivering lipstick and lip gloss to appropriate locations on the lips. In addition, the pendant cross-sectional shape of the bullet offers an improved ergonomic solution. The pointed tip ensures that the application will be sharp and precise, particularly in the cusp of the upper lips and the corners between the upper and lower lips. The bottom rounded portion of the periphery ensures proper product placement on the lower edge of the lower lip without straying off the lips.

The provision of three compositions in the described arrangement offers three distinct benefits in one to achieve a multi-dimensional look with a simple application process. The lip liner composition and placement in the bullet structure provides definition of the edges of the lips and prevents lipstick and/or lip gloss from bleeding and feathering beyond the edges of the lips. The lipstick color provides full color coverage at targeted desired locations on the lip. And the lip gloss core provides shine to help volumize lips by giving a sheen that is believed to contribute to the appearance of fuller lips.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A combined lipstick, lip gloss and lip liner bullet comprising:

a body defining a longitudinal axis and a cross-section of the bullet, the cross-section defining a periphery of the body, and the body further comprising:

an application face approximately defined by the cross-section of the bullet, the application face having an upper portion and a lower portion;

a lip gloss core centered in the body along the longitudinal axis;

a lipstick sheath coaxially enveloping the lip gloss core;

an upper lip liner part positioned in the sheath such that an end is exposed in the upper portion of the application face on the periphery, the upper lip liner part extending parallel to the longitudinal axis on a first side of the body; and a lower lip liner part positioned in the sheath such that an end is exposed in the lower portion of the application face on the periphery, the lower lip liner part extending parallel to the longitudinal axis on a second side of the body opposite the first side.

2. The combined lipstick, lip gloss and lip liner bullet of claim 1 wherein the cross-section is a pendant shape having a wedge-shaped upper half defining an apex in the periphery and a semi-circular shaped lower half defining a rounded portion of the periphery.

3. The combined lipstick, lip gloss and lip liner bullet of claim 2 wherein the upper lip liner part is positioned on the periphery in the apex and the lower lip liner part is positioned on the periphery at approximately a center of the rounded portion.

4. The combined lipstick, lip gloss and lip liner bullet of claim 3 wherein a line taken through a center point of the body, the center of the rounded portion and the apex defines a radial axis of the body, and the upper lip liner part, the lower lip liner part and the core are aligned along the radial axis.

5. The combined lipstick, lip gloss and lip liner bullet of claim 3 wherein a cross-section of at least one of the upper lip liner part and the lower lip liner part is selected from one of a circle, an oval, a semi-circle, a triangle, a square, a rectangle, a hexagon, a trapezoid or a combination thereof.

6. The combined lipstick, lip gloss and lip liner bullet of claim 1 wherein the upper lip liner part is dimensioned and adapted to be applied to an upper edge of an upper lip, and the lower lip liner part is dimensioned and adapted to be applied to a lower edge of a lower lip.

7. The combined lipstick, lip gloss and lip liner bullet of claim 1 wherein a cross-section of the core is selected from one of a circle, an oval, a semi-circle, a triangle, a square, a rectangle, a hexagon, a trapezoid or a combination thereof.

8. The combined lipstick, lip gloss and lip liner bullet of claim 1 wherein the cross section of the body is selected from one of a circle, an oval, a semi-circle, a triangle, a square, a rectangle, a hexagon, a trapezoid or a combination thereof.

9. A combined lipstick, lip gloss and lip liner bullet comprising:

a body defining a longitudinal axis and a cross-section of the bullet, the cross-section defining a periphery of the body, the cross section is a pendant shape having a wedge-shaped upper half defining an apex in the periphery and a semi-circular shaped lower half defining a rounded portion of the periphery, and the body further comprising:

an application face approximately defined by the cross-section of the bullet, the application face having an upper portion and a lower portion;

a lip gloss core centered in the body along the longitudinal axis;

a lipstick sheath coaxially enveloping the lip gloss core;

an upper lip liner part positioned in the sheath such that an end is exposed in the upper portion of the application face on the periphery, the upper lip liner part extending parallel to the longitudinal axis on a first side of the body, the upper lip liner part dimensioned and adapted to be applied to an upper edge of an upper lip; and a lower lip liner part positioned in the sheath such that an end is exposed in the lower portion of the application face on the periphery, the lower lip liner part extending parallel to the longitudinal axis on a second side of the body opposite the first side, the lower lip liner part dimensioned and adapted to be applied to a lower edge of a lower lip.

10. A method of using a combined lipstick, lip gloss and lip liner bullet according to claim 9, the method comprising:

placing the upper portion of the application face against an upper lip such that the exposed end of the upper lip liner part contacts an upper edge of the upper lip and at least a portion of the lipstick sheath and lip gloss core contact the upper lip, and drawing the bullet laterally across the lip to simultaneously deposit lipstick, lip gloss and lip liner; and placing the lower portion of the application face against a lower lip such that the exposed end of the lower lip liner part contacts a lower edge of the lower lip and at least a portion of the lipstick sheath and lip gloss core contact the lower lip, and drawing the bullet laterally across the lip to simultaneously deposit lipstick, lip gloss and lip liner.

* * * * *